US006644363B2

(12) United States Patent
Sogliani et al.

(10) Patent No.: US 6,644,363 B2
(45) Date of Patent: Nov. 11, 2003

(54) EQUIPMENT FOR FILLING CONTAINERS WITH MATERIALS, PREFERABLY LIQUIDS

(75) Inventors: Claudio Sogliani, Mantova (IT); Stefano Cavallari, Bologna (IT)

(73) Assignee: Azionaria Costruzioni Macchine Automatiche A.C.MA. S.p.A., Bologna (IT)

( * ) Notice: Subject to any disclaimer, the term of this patent is extended or adjusted under 35 U.S.C. 154(b) by 0 days.

(21) Appl. No.: 10/098,526

(22) Filed: Mar. 18, 2002

(65) Prior Publication Data

US 2002/0134460 A1 Sep. 26, 2002

(30) Foreign Application Priority Data

Mar. 21, 2001 (IT) ..... BO2001A0161

(51) Int. Cl.[7] ..... B65B 3/00

(52) U.S. Cl. ..... 141/83; 141/94; 141/101; 141/104; 141/145

(58) Field of Search ..... 141/9, 83, 94, 141/95, 100, 101, 104–107, 144, 145, 153

(56) References Cited

U.S. PATENT DOCUMENTS

| | | | | |
|---|---|---|---|---|
| 1,804,985 A | | 5/1931 | Hoffman | |
| 2,060,276 A | | 11/1936 | Bondurant | |
| 4,136,719 A | | 1/1979 | Kronseder et al. | |
| 4,676,286 A | | 6/1987 | Aiuola et al. | |
| 5,148,841 A | * | 9/1992 | Graffin | 141/83 |
| 5,287,896 A | | 2/1994 | Graffin | 141/9 |
| 5,515,888 A | * | 5/1996 | Graffin | 141/1 |
| 5,700,982 A | * | 12/1997 | Neuman | 177/229 |
| 5,713,403 A | | 2/1998 | Clüsserath et al. | 141/101 |
| 6,148,876 A | | 11/2000 | Corniani | |

FOREIGN PATENT DOCUMENTS

| | | |
|---|---|---|
| DE | 2649758 | 5/1978 |
| DE | 2736332 | 2/1979 |
| DE | 2848988 | 5/1980 |
| EP | 0052546 | 5/1982 |
| EP | 0373396 | 6/1990 |
| EP | 1072511 | 1/2001 |
| FR | 1208576 | 2/1960 |
| FR | 2168696 | 8/1973 |
| GB | 974519 | 11/1964 |

* cited by examiner

*Primary Examiner*—J Casimer Jacyna
(74) *Attorney, Agent, or Firm*—Davidson Berquist Klima & Jackson, LLP

(57) ABSTRACT

Containers are filled with liquids by equipment incorporating a carousel rotatable about a vertical axis, and a number of filler heads mounted to the carousel, each comprising a platform on which to set a container, a nozzle aligned with the platform and serving to direct at least one type of liquid into the container, also a dynamometer associated with the platform and sensing the weight of the container. The equipment includes at least one tank holding at least one liquid to be batched into the containers, and a fixed pipeline of which a first end is connected to the tank and a second end is connected by way of a rotary coupling to a manifold at the top of the carousel.

13 Claims, 4 Drawing Sheets

EQUIPMENT FOR FILLING CONTAINERS WITH MATERIALS, PREFERABLY LIQUIDS

BACKGROUND OF THE INVENTION

The present invention relates to equipment for filling containers with materials, preferably liquids.

The prior art embraces equipment for filling containers with liquid materials, furnished with a carousel that carries a plurality of filler heads each comprising a dispensing nozzle from which a predetermined quantity of material can be directed into a relative container positioned on a platform. The single container is advanced by the carousel from an infeed station at which it is placed on one of the platforms, toward an outfeed station where, having been filled with the material being batched, it is removed from the carousel and conveyed to a further stage of the production cycle.

The material dispensed into the containers can be held in a tank mounted directly above the carousel. This solution favors the embodiment of equipment exhibiting compact geometry and manageable overall dimensions, but severely limits the versatility of the carousel in terms of use.

In effect, one material only can be dispensed into the containers, signifying in practice that a single carousel cannot be used during the course of a given production run to fill all the containers with more than one material, or to fill different containers with different materials. There are also difficulties experienced in cleaning the dispensing nozzles, a particularly important operation in the case of perishable materials such as foodstuffs. The nozzles and their delivery systems can in point of fact be flushed through only after the tank has been emptied completely and filled with a cleansing solution.

To overcome the drawbacks in question, the prior art embraces machines equipped with a plurality of fixed tanks installed separately from the carousel and connected to the dispensing nozzles by way of pipelines. Using equipment of this type, a single carousel can be supplied with different materials at one and the same time, and a single container can be filled with two or more different materials.

The prescribed quantity of each material to be dispensed into the single container is measured by time: the nozzles incorporate filler valves that remain open to allow passage of the material for a predetermined interval of time only.

These measurements are none too accurate however, being strictly dependent on the physical conditions to which the material is subject.

Marginal changes in ambient conditions can thus significantly affect the mass of material dispensed into the container.

In the case of liquids, for example, temperature has a notable effect on viscosity, and consequently on the rate at which the material flows through the pipelines connecting the tanks to the nozzles. The measurement of a time allowed for a liquid to flow, when the amount of the flow is notably variable, cannot therefore ensure accurate control over the quantity of material directed into the containers.

The object of the present invention is to provide equipment capable of dispensing markedly precise quantities of different materials into containers.

SUMMARY OF THE INVENTION

The stated object is duly realized according to the present invention in equipment for filling containers with materials, preferably liquids, comprising a carousel rotatable about a first axis, and a plurality of filler heads mounted to the carousel, each presenting a support on which to stand a container, a dispensing device aligned with the support and serving to direct at least one material into the container, also means associated with the support, of which the function is to weigh the container.

The equipment also comprises at least one tank holding at least one material to be dispensed into the containers, and connection means operating between the tank and the dispensing devices, by which the dispensing devices are supplied with the material held in the tank.

In a preferred embodiment, the equipment includes a plurality of tanks each having a fixed base and containing a relative material to be dispensed into at least one of the containers, and the connection means operate between each tank and at least one of the dispensing devices.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
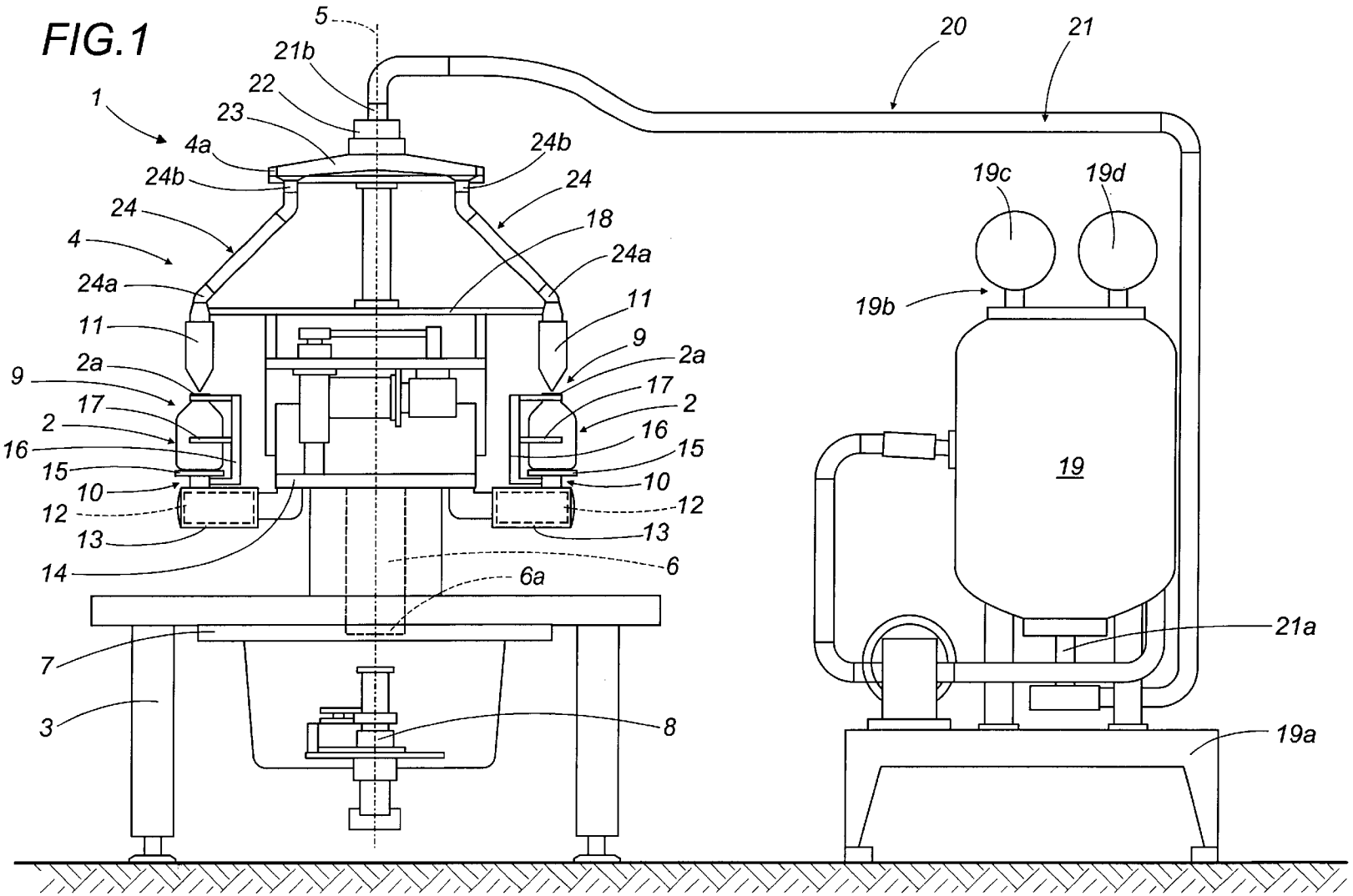
FIG. 1 shows a first embodiment of equipment according to the present invention, illustrated in a side elevation with certain parts omitted for clarity.

With reference to FIG. 1 of the accompanying drawings, 1 denotes equipment, in its entirety, for filling containers 2 with materials, and preferably with liquids.

The equipment comprises a frame 3 supporting a carousel 4 rotatable about a substantially vertical first axis denoted 5. The carousel 4 is carried by a shaft 6, mounted rotatably to the frame 3 and coinciding with the first axis 5, of which a bottom end 6*a* is coupled to a flange 7 carrying means 8 of familiar type, and therefore not described further, by which the carousel 4 is set in rotation.

The shaft 6 also carries a plurality of filler heads 9 disposed circumferentially on the carousel, equispaced angularly about the first axis 5. Each filler head 9 comprises a support 10 on which to stand one of the containers 2, also a dispensing device 11 aligned with the support 10 and able thus to direct at least one material into the mouth 2*a* of a container 2, and means 12 associated with the support 10, by which to weigh the container 2.

Each support 10 is carried by an arm 13 connected to a second flange 14 mounted on the shaft 6, and presents a platform 15 on which to stand a single container 2, the platform 15 in turn presenting an upright 16 with lateral appendages 17 by which the container 2 is restrained.

The dispensing devices 11 are arranged around the periphery of a circular third flange 18, aligned on the vertical axes of the respective platforms 15. Each of the dispensing devices 11, which are of a conventional type, can be made to alternate between an operating condition in which it directs at least one material into the container 2, and at least one non-operating condition in which it does not direct material into the container 2. The change in state of the dispensing devices between the operating and the non-operating condition occurs according to the weight of the material directed into the container, as will be described in due course, and is piloted by a controller of conventional type (and therefore not illustrated in the drawings) connected to the weighing means 12.

The dispensing devices 11 are supplied from at least one tank 19 containing the material to be batched into the containers 2. The tank 19 stands on a fixed base 19*a* detached from the carousel 4 and is embodied, advantageously, as a fluid-tight enclosure comprising means 19*b* by which to vary the pressure within the selfsame enclosure; such means consist in a aspirator 19*c* operating internally of the tank 19 in such a manner as to remove air from the enclosed space and thus reduce pressure, and a compressor 19*d* operating internally of the tank 19 in such a manner as to force air into the space and thus increase pressure.

The equipment 1 comprises connection means 20 operating between the tank 19 and the dispensing devices 11, comprising a fixed pipeline 21 of which a first end 21*a* is connected to the tank 19 and a second end 21*b* is connected by way of a rotary coupling 22 to a manifold 23 positioned at the top end 4*a* of the carousel 4. The manifold 23 provides a fluid connection between the fixed pipeline 21 and a plurality of movable pipelines 24 associated rigidly with the carousel 4, each connected by a first end 24*a* to a relative dispensing device and interfaced by way of a second end 24*b* with the manifold 23.

In an alternative embodiment, the manifold 23 of the connection means 20 might be associated rigidly with the fixed pipeline 21 and coupled rotatably to the movable pipelines 24.

Figure 2:
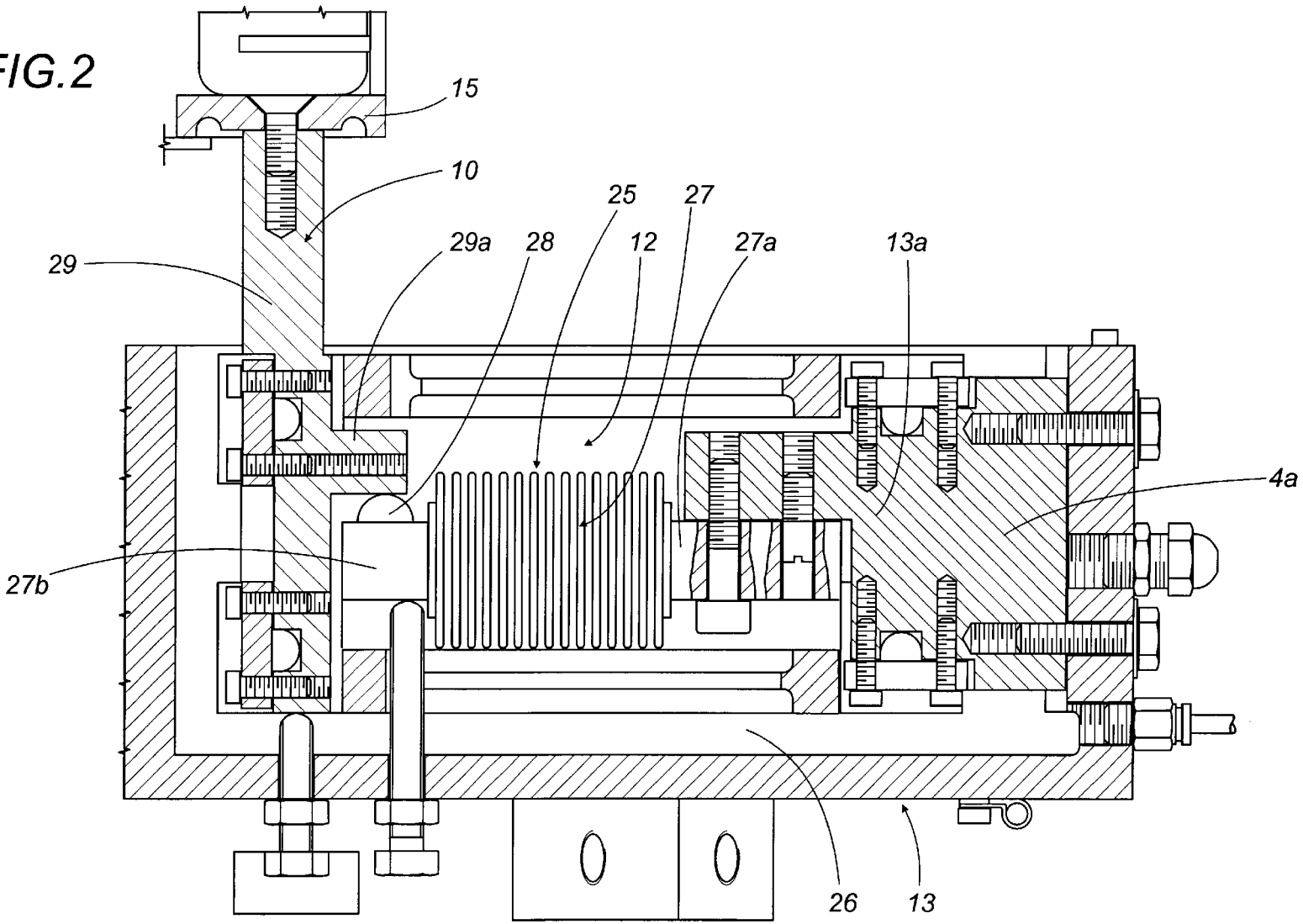
FIG. 2 is a detail of FIG. 1, illustrated in a side elevation with certain parts in section.

Referring to FIG. 2, a preferred embodiment of the weighing means 12 will include a dynamometer 25 housed internally of a cavity 26 afforded by each arm 13 of the carousel 4. The dynamometer 25 is associated with the support 10 in such a way as to measure a force acting vertically on the selfsame support 10. More precisely, the dynamometer 25 comprises an electrical strain gauge 27 of which a first end 27*a* is anchored to a central portion 4*a* of the carousel 4, or in practice to a portion 13*a* of the arm 13, and a second end 27*b* associated with the support 10 presents a contact element 28. Each support 10 presents a stem 29 extending vertically downward from the platform 15 and partly occupying the cavity 26. The stem 29 exhibits a transverse projection 29*a* against which the contact element 28 of the dynamometer is caused to locate; thus, the support 10 is connected to the arm 13 in such a way that the weight of the container 2 bears on the second end 27*b* of the strain gauge 27. The weighing means 12 also comprise a transducer of conventional type (not illustrated in the drawings), connected to the strain gauge 27, which is able to sense the deformation of the gauge induced by the weight of the container 2 and relay a corresponding signal to the controller.

Figure 3:
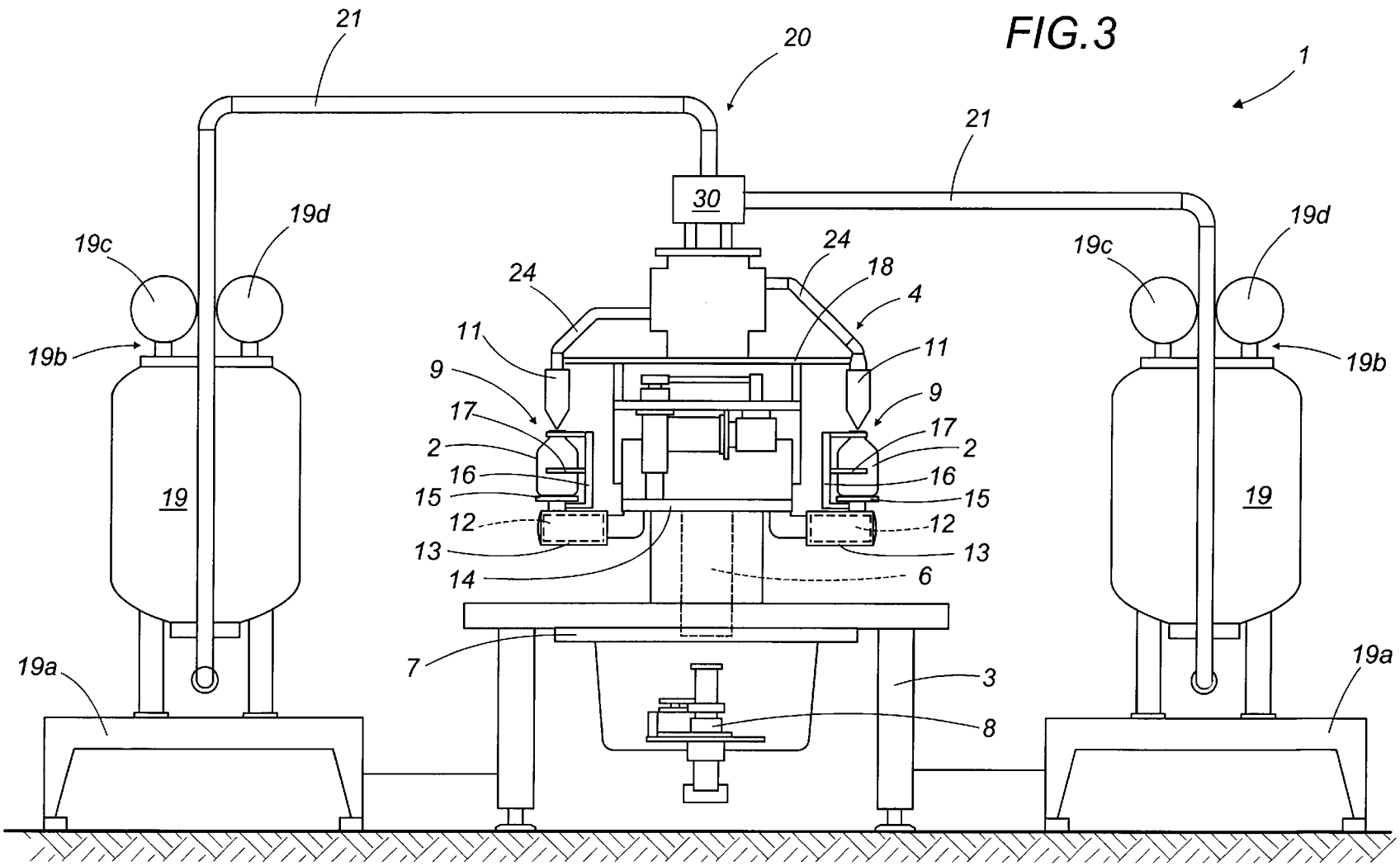
FIG. 3 shows a second embodiment of equipment according to the present invention, illustrated in a side elevation with certain parts omitted for clarity.

With reference to FIG. 3, which illustrates a second embodiment of the invention, the equipment 1 comprises a plurality of tanks 19 each presenting the same characteristics as the tank 19 of FIG. 1 described previously and containing a relative material to be directed into at least one of the containers 2.

In this instance the connection means 20 operate between each single tank 19 and at least one of the dispensing devices 11 mounted to the carousel 4, of the type described above. In effect, the connection means 20 comprise a plurality of fixed pipelines 21 each extending between a respective tank 19 and the manifold.

To the end that all the dispensing devices 11 can be supplied with a given material at once, each of the fixed pipelines 21 is controlled by a valve 30 pilotable between a number of operating conditions, each corresponding to a situation in which one of the fixed pipelines 21 is opened and the remainder are all closed.

Figure 4:
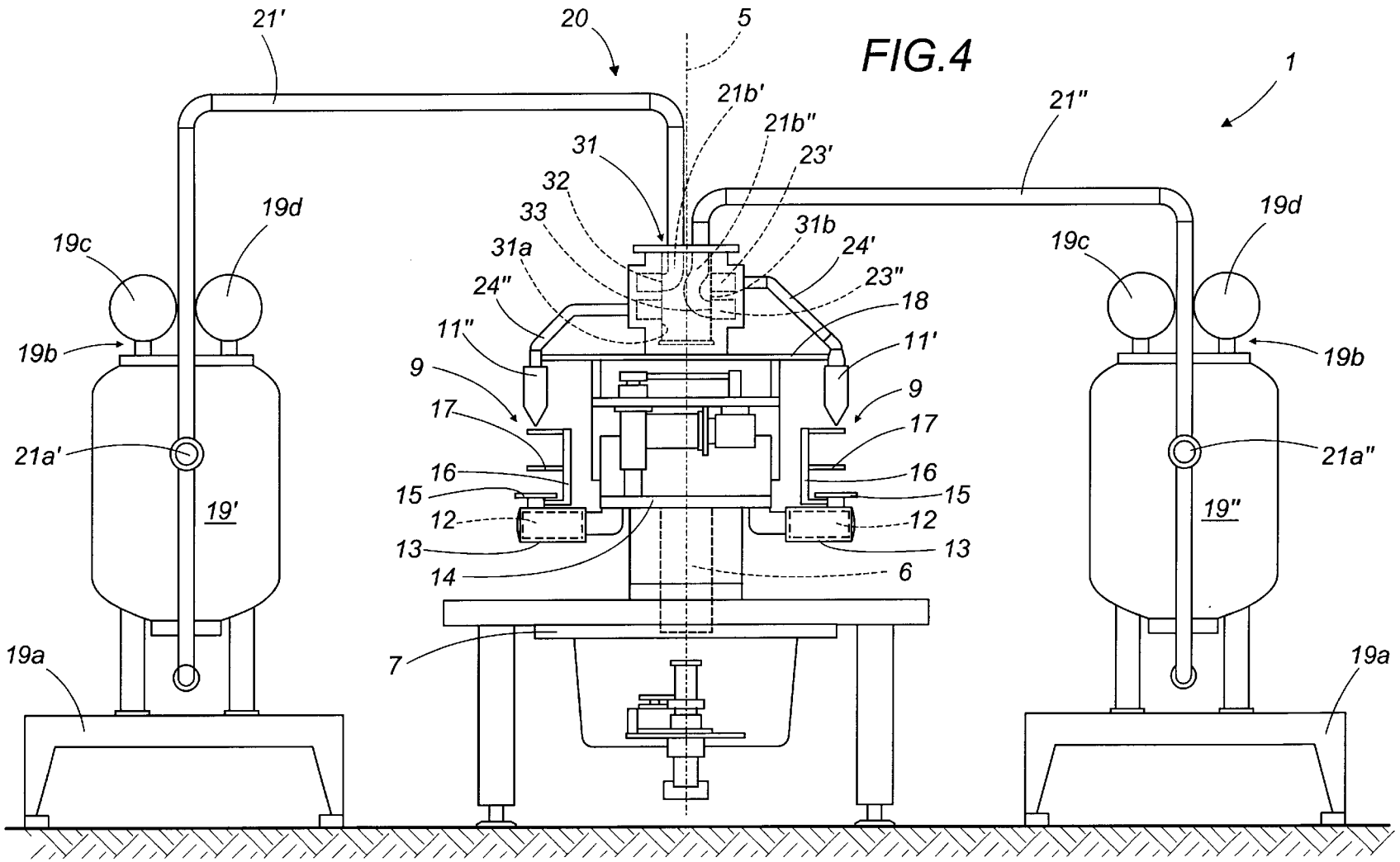
FIG. 4 shows a third embodiment of equipment according to the present invention, illustrated in a side elevation with certain parts omitted for clarity.

Referring to FIG. 4, which illustrates a third embodiment of the present invention, the connection means 20 are configured in such a way as to allow of supplying different dispensing devices 11 with different materials simultaneously. In this example the equipment comprises a plurality of manifolds 23 each connected to a single tank 19 and supplying a relative set of dispensing devices 11.

In particular, observing FIG. 4, the equipment comprises a first tank denoted 19', holding a first product, to which the first end 21*a*' of a first fixed pipeline 21' is connected. A second end 21*b*' of the first fixed pipeline 21' is connected to the internal wall 31*a* afforded by a tubular housing 31 occupying a fixed position and centered on an axis that coincides with the first axis 5. At the point where this same second end 21*b*' of the first fixed pipeline 21' is connected, the tubular housing 31 presents a first passage 32 by way of which the first fixed pipeline 21' is connected to a first annular manifold 23' centered on the first axis 5 and breasted rotatably with an external wall 31*b* of the housing 31. The first annular manifold 23' in turn is connected to at least one first dispensing device 11' by way of at least one first movable pipeline 24'.

The equipment of FIG. 4 further comprises a second tank 19" holding a second product, to which the first end 21*a*" of a second fixed pipeline 21" is connected. A second end 21*b*" of the second fixed pipeline 21" is connected to the internal wall 31*a* of the fixed tubular housing 31, and at the point where this same second end 21*b*" of the second fixed pipeline 21' is connected, the tubular housing 31 presents a second passage 33 by way of which the second fixed pipeline 21" is connected to a second annular manifold 23" centered on the first axis 5 and breasted rotatably with the external wall 31*b* of the housing 31. The second annular manifold 23" is connected to at least one second dispensing device 11" by way of at least one second movable pipeline 24".

The operation of the equipment 1, of which the various embodiments have been described thus far prevalently in structural terms, is as follows.

When an empty container 2 is positioned on the support 10 of a filler head 9, its tare value is first measured by the relative weighing means 12. Thereafter, the dispensing device 11 is activated and material held in the tank 19 will be directed into the container 2. The pressure of the flow of material supplied to the dispensing devices 11 can be controlled by varying the pressure internally of the tank 19 through the agency of the negative or positive pressurizing means 19*b* mentioned above. Citing Italian patent application BO98A 000457 in this regard, where the material being batched into the containers 2 is an especially viscous liquid, it may be advantageous to raise the pressure in the tank so that the material reaches the containers 2 more quickly. Conversely, where the material being batched into the containers 2 is a readily foamable fluid, it may help to maintain low pressure in the tank and thus prevent the dispensing devices from releasing a jet into the relative container with a force likely to generate an appreciable quantity of foam.

During the fill, the weight of the container 2 is monitored by the weighing means 12. The moment that these same means measure a value equal to the tare of the container 2, plus the predetermined weight of the material to be dispensed into the container, the relative controller causes the flow of material to be cut off by piloting the relative dispensing device 11 to revert to the non-operating condition. The dosage of the prescribed quantity of material dispensed into each container 2 is thus rendered notably accurate and reliable.

When the dispensing devices 11 and the relative pipelines 24 and 21 need flushing through, it will be sufficient to connect the fixed pipeline 21 to a source of cleansing fluid. Accordingly, it becomes possible to clean the equipment 1 thoroughly, and without emptying the tank 19 holding the material to be dispensed into the containers 2.

In the case of the second embodiment illustrated in FIG. 3, the equipment 1 is able to dispense precise quantities of different materials into each of the single containers 2. In this instance, the controller first causes the valve 30 to connect the dispensing devices 11 to a tank 19 holding a first material to be batched into the containers 2. When the weighing means 12 indicate that the quantity of the first material dispensed into the container is equal to that prescribed, the valve 30 will connect the dispensing devices 11 to a tank 19 holding another material to be batched in the containers. Accordingly, it becomes possible to fill the single containers 2 with different quantities of different materials, each of which corresponding exactly to a prescribed value.

In the case of the third embodiment illustrated in FIG. 4, the equipment 1 is able to distribute different materials into different containers. To advantage, a first set of dispensing devices 11' can be connected to a first tank 19' holding a first material, whilst a second set of dispensing devices 11" can be connected to a second tank 19" holding a second material. The weighing means 12 associated with each filler head will again ensure that the correct quantity of material is dispensed into each container 2. Accordingly, containers can be filled with different materials using a single carousel, and the versatility of the equipment 1 is enhanced further.

What is claimed is:

1. Equipment for filling containers with materials, comprising:

a carousel rotatable about a first axis;

a plurality of filler heads mounted to the carousel, each presenting a support on which to stand a container;

a dispensing device aligned with each support and serving to direct at least one material into the container;

means associated with the support, by which to weigh the container;

at least one tank holding at least one material to be dispensed into the containers, and connection means operating between the tank and the dispensing devices, by which the dispensing devices are supplied with the material held in the tank, the connection means comprising:

at least one fixed pipeline connected to at least one of the tanks, a plurality of movable pipelines, each connected to one of the dispensing devices, rotatable with the carousel as one about the first axis and coupled to the fixed pipeline by way of a fluid connection, and a manifold with which both the fixed pipeline and the movable pipelines are interfaced, the movable pipelines connected in rigid association with the manifold and the fixed pipeline connected in rotatable association with the manifold.

2. Equipment as in claim 1, comprising a plurality of tanks, each containing a relative material to be dispensed into at least one of the containers, wherein the connection means operate between each tank and at least one of the dispensing devices.

3. Equipment as in claim 2, wherein each tank presents a fixed base detached from the carousel.

4. Equipment as in claim 1, wherein each tank presents a fixed base detached from the carousel.

5. Equipment as in claim 1, comprising a plurality of manifolds, a plurality of fixed pipelines and a plurality of movable pipelines, wherein each of the manifolds is connected to a respective tank by way of one of the fixed pipelines and to at least one respective dispensing device by way of one of the movable pipelines.

6. Equipment as in claim 1, wherein each dispensing device can be made to alternate between an operating condition in which it directs at least one material into the container, and at least one non-operating condition in which it does not direct material into the container, each filler head comprising a controller connected to the weighing means and able to pilot the alternation of the respective dispensing device between the operating and the non-operating condition.

7. Equipment as in claim 6, wherein the weighing means comprise a dynamometer connected to the support in such a way as to measure a force acting vertically on the selfsame support.

8. Equipment as in claim 7, wherein the dynamometer comprises an electrical strain gauge of which a first end is connected to a central portion of the carousel and a second end associated with the support, also a transducer operating between the strain gauge and the controller.

9. Equipment as in claim 1, wherein at least one of the tanks is furnished with means by which to vary the pressure inside the selfsame tank.

10. Equipment for filling containers with materials, comprising:

a carousel rotatable about a first axis;

a plurality of filler heads mounted to the carousel, each presenting a support on which to stand a container;

a dispensing device aligned with each support and serving to direct at least one material into the container;

means associated with the support, by which to weigh the container;

at least one tank holding at least one material to be dispensed into the containers, and connection means operating between the tank and the dispensing devices, by which the dispensing devices are supplied with the material held in the tank, wherein the connection means comprise:

a plurality of fixed pipelines, a plurality of movable pipelines, each connected to one of the dispensing devices, rotatable with the carousel as one about the first axis and coupled to the fixed pipeline by way of a fluid connection, and a manifold with which both the fixed pipelines and the movable pipelines are interfaced, each of the fixed pipelines extending between a relative tank and the manifold, and at least one valve operating on at least one of the fixed pipelines and pilotable between respective conditions in which the fixed pipeline is open and closed.

11. Equipment for filling containers with materials, comprising:

a carousel rotatable about a first axis;

a plurality of filler heads mounted to the carousel, each presenting a support on which to stand a container;

a dispensing device aligned with each support and serving to direct at least one material into the container;

means associated with the support, by which to weigh the container;

at least one tank holding at least one material to be dispensed into the containers, and connection means operating between the tank and the dispensing devices, by which the dispensing devices are supplied with the material held in the tank, wherein at least one of the tanks is furnished with means by which to vary the pressure inside the tank, wherein the tank is a fluid-tight enclosure and the pressure variation means comprise an aspirator operating internally of the tank in such a manner as to remove air from the enclosure and thus reduce pressure in the tank.

12. Equipment as in claim 11, wherein the tanks are fluid-tight enclosures and pressure variation means comprise a compressor operating internally of the tank in such a manner as to force air into the enclosure and thus increase pressure in the tank.

13. Eqiuipment for filling containers with materials, comprising:

a carousel rotatable about a first axis;

a plurality of filler heads mounted to the carousel, each presenting a support on which to stand a container;

a dispensing device aligned with each support and serving to direct at least one material into the container;

means associated with the support, by which to weigh the container;

at least one tank holding at least one material to be dispensed into the containers, and connection means operating between the tank and the dispensing devices, by which the dispensing devices are supplied with the material held in the tank, wherein at least one of the tanks is furnished with means by which to vary the pressure inside the tank, wherein the tank is a fluid-tight enclosure and the pressure variation means comprise a compressor operating internally of the tank in such a manner as to force air into the enclosure and thus increase pressure in the tank.

* * * * *